US006946792B2

(12) United States Patent
Kimura et al.

(10) Patent No.: US 6,946,792 B2
(45) Date of Patent: Sep. 20, 2005

(54) PHOTOMULTIPLIER

(75) Inventors: Suenori Kimura, Hamammatsu (JP); Masami Furuhashi, Hamamatsu (JP); Tomohiro Ishizu, Hamamatsu (JP); Masuo Ito, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 191 days.

(21) Appl. No.: 10/333,846

(22) PCT Filed: Jul. 19, 2001

(86) PCT No.: PCT/JP01/06279

§ 371 (c)(1),
(2), (4) Date: Jan. 24, 2003

(87) PCT Pub. No.: WO02/11179

PCT Pub. Date: Feb. 7, 2002

(65) Prior Publication Data

US 2003/0132370 A1 Jul. 17, 2003

(30) Foreign Application Priority Data

Jul. 27, 2000 (JP) ..... 2000-227382

(51) Int. Cl.[7] ..... H01J 43/04

(52) U.S. Cl. ..... 313/532; 313/103 R; 313/105 R; 250/207

(58) Field of Search ..... 313/528, 532, 313/103 R, 103 CM, 104, 541, 105 R, 105 CM; 250/207, 214 VT

(56) References Cited

U.S. PATENT DOCUMENTS

| | | | | | |
|---|---|---|---|---|---|
| 2,231,698 | A | * | 2/1941 | Zworykin et al. | 313/536 |
| 5,598,061 | A | * | 1/1997 | Nakamura et al. | 313/532 |
| 5,616,987 | A | * | 4/1997 | Ohmura et al. | 313/533 |
| 5,680,007 | A | * | 10/1997 | Niigaki et al. | 313/527 |
| 5,914,561 | A | * | 6/1999 | Venkatarao et al. | 313/533 |
| 6,232,715 | B1 | | 5/2001 | L'Hermite | |

FOREIGN PATENT DOCUMENTS

| | | |
|---|---|---|
| JP | 52-8377 | 2/1977 |
| JP | A 2-291655 | 12/1990 |
| JP | A 10-214588 | 8/1998 |
| WO | WO 98/33202 | 7/1998 |

* cited by examiner

*Primary Examiner*—Nimeshkumar D. Patel
*Assistant Examiner*—German Colón
(74) *Attorney, Agent, or Firm*—Oliff & Berridge PLC

(57) ABSTRACT

A photomultiplier excellent in vibration resistance and improved in pulse linearity characteristic and time-response. The fourth, and sixth to ninth dynodes (Dy4, Dy6 to Dy9) have a similar shape to that of the second dynode (Dy2). The third and fifth dynodes (dy3, Dy5) are smaller than the dynode (Dy2). The first to tenth dynodes (Dy1 to Dy10) are so arranged that the dynode inner space path defined between opposed dynodes is perpendicular to the tube axis (X). The anode (A) is a mesh anode (A), and is opposed to the dynode (Dy2) with respect to the tube axis (X).

12 Claims, 5 Drawing Sheets

PHOTOMULTIPLIER

This application is a 371 application of PCT/JP01/06279, filed Jul. 19, 2001.

TECHNICAL FIELD

The present invention relates to a photomultiplier tube, and particularly to a photomultiplier tube with excellent vibration resistance and improved pulse linearity characteristics and time response.

BACKGROUND ART

Japanese unexamined patent application publication 2-291655 discloses a photomultiplier tube having a circular cage type electron multiplying unit. In the circular cage type electron multiplying unit, a path formed in the spaces between opposed dynodes traces a circle around an axis orthogonal to the tube axis. The second dynode and the anode are positioned on opposing ends in relation to the tube axis. Accordingly, the photomultiplier tube can be contracted in its axial direction, reducing the overall size of the tube construction.

In order to form a circular path in the spaces between opposed dynodes, concave dynodes are positioned on the outer side of the path, while dynodes having a substantially flat surface are arranged on the inner side of the path, wherein the inner dynodes have a smaller surface area than those of the outer dynodes. The anode is pole-shaped, but configured to encompass the last dynode. This anode has exceptional resistance to vibration due to its pole shape.

However, since the surface area of dynodes positioned on the inner side of the path is smaller than that of the dynodes disposed on the outer side of the path, the electron density increases near the dynodes positioned on the inside of, the path. Since electrons are sequentially multiplied as they approach the anode, the electron density near the penultimate dynode becomes extremely high, as the surface area of this dynode is small. Accordingly, an undesirable space charge effect can easily occur. Moreover, with its pole shape, the anode has weak electric field intensity. The circular cage type electron multiplying unit construction disclosed in Japanese unexamined patent application publication 2-291655 has poor pulse linearity due to the problems of the space charge effect and the weak electric field intensity. That is, the output signal does not increase linearly with the increase in inputted optical intensity. Rather the output signal level drops.

A photomultiplier tube designed to improve pulse linearity is disclosed in Japanese unexamined patent application 7-245078. As in the photomultiplier tube of Japanese unexamined patent application publication 2-291655 described above, this publication provides a photomultiplier tube having a shortened length along the tube axis by providing the second dynode and the anode on opposing ends of the tube. In this photomultiplier tube, the electron multiplying unit having a plurality of dynode includes a first section formed of a plurality of box and grid dynodes and a second section formed of a plurality of line focus dynodes. The path formed in the spaces between facing dynodes is curved by arranging box shaped dynodes in the first section, while the path formed in the spaces between facing dynodes in the second section follows a straight line using the plurality of line focus dynodes. The anode has a flat mesh shape and is positioned between the last dynode and the penultimate dynode.

With this construction, line focus dynodes having an equivalent size are used in the second section where the electron density is increasing, thereby preventing an increase in electron density and restraining the space charge effect.

Since the anode in the photomultiplier tube of Japanese unexamined patent application publication 7-245078 has a mesh shape, it is possible to increase the intensity of the electric field. Hence, this photomultiplier tube can improve pulse linearity, unlike the circular cage type electron multiplying construction of Japanese unexamined patent application publication 2-291655.

As described above, the photomultiplier tube of Japanese unexamined patent application publication 7-245078 uses box-shaped dynodes in the electron multiplying unit. These box-shaped dynodes have a large and complex construction including a box-type secondary electron emitting unit and a grid, making it difficult to manufacture a photomultiplier tube that is compact in size with a capacity to withstand vibrations.

Further, the travel time of the electrons increases among these box-type dynodes, resulting in an insufficient time response.

In view of the foregoing, it is an object of the present invention to provide a photomultiplier tube having good vibration resistance and pulse linearity characteristics and being capable of improving time response.

DISCLOSURE OF THE INVENTION

The photomultiplier tube according to the present invention includes a tube-shaped vacuum vessel extending along the tube axis; a photocathode positioned on one end of the tube axis of the tube-shaped vacuum vessel for converting incident light to electrons; first to $n^{th}$ dynodes, each of which has a secondary electron surface formed on an inner wall for multiplying electrons sequentially; and an anode for receiving the electrons multiplied by the of dynodes. When i is an integer greater than or equal to 2 and less than or equal to (n−1), a secondary electron surface of an $i^{th}$ dynode is positioned opposite the secondary electron surfaces of the $(i-1)^{th}$ and $(i+1)^{th}$ dynodes. A dynode having approximately the same shape as the second dynode is used as the $(n-2)^{th}$ and $(n-1)^{th}$ dynodes, while the third and fifth dynodes are smaller than the second dynode. The n dynodes are arranged such that the path formed in the spaces between opposing dynodes cross the tube axis. Here, a mesh anode is used as the anode, the mesh anode is placed opposite to the second dynode in relation to the tube axis.

With this construction, the third and fifth dynodes are smaller than the second dynode. Accordingly, the anode can be positioned opposite to the second dynode in relation to the tube axis, enabling the photomultiplier tube to be constructed more compactly in the axial dimension.

Moreover, by forming the $(n-1)^{th}$ and the $(n-2)^{th}$ dynodes in approximately the same shape as the second dynode, the electron density does not increase excessively near the $(n-1)^{th}$ and $(n-2)^{th}$ dynodes. Accordingly, it is possible to reduce the influence of space charge and to improve pulse linearity. Further, by forming the anode in a mesh construction, the anode can be placed near the last dynode, thereby increasing the electric field intensity through parallel electric fields and restraining the influence of the space charge effect. With this construction, the pulse linearity can be further improved. Moreover, electrons can be received over a relatively wider range.

The secondary electron surface in the second dynode in the photomultiplier tube of the present invention is formed of a curved surface having an arcuate cross-section and a flat surface continuous and flush with the curved surface.

A photomultiplier tube of this construction has better resistance to vibrations than that using a box and grid type dynode, as the dynode construction is simple and small. Accordingly, the photomultiplier tube can be used in an environment requiring a high resistance to vibration, such as in the exploration for oil resources. Further, the photomultiplier tube has good time response.

In the photomultiplier tube of the present invention, the $(n-3)^{th}$ dynode has a substantially identical shape with the second dynode.

Accordingly, the present invention can prevent an excessive increase of electron density around the $(n-3)^{th}$ dynode to further improve pulse linearity characteristics.

In the photomultiplier tube of the present invention, the $(n-4)^{th}$ dynode has substantially the same shape as the second dynode. Hence, the photomultiplier tube of the present invention can prevent an excessive increase in electron density near the $(n-4)^{th}$ dynode, thereby further improving pulse linearity.

In the photomultiplier tube of the present invention, the secondary electron surfaces of the third and fifth dynodes are formed only of a curved surface having an arcuate cross-section. Accordingly, electrons are easily received from dynodes in the first section and the secondary electrons can be made to follow an appropriate trajectory in relation to the dynodes in the second section by adjusting the secondary electron emitting direction slightly toward the dynodes of the first section.

Further, in the photomultiplier tube of the present invention, the third and fifth dynodes can be formed to approximately resemble the second dynode.

By forming the third and fifth dynodes similar to the second dynode, the third and fifth dynodes being smaller than the second dynode, the same effects as that of when the secondary electron surfaces of the third and fifth dynodes are made in order to have only a curved surface with an arcuate cross-section can be attained.

In the photomultiplier tube of the present invention, it is possible to provide a shielding plate between the first dynode and the $(n-3)^{th}$ through $n^{th}$ dynodes.

This construction can prevent light and ions generated when electrons collide with the $(n-3)^{th}$ through $n^{th}$ dynodes from traveling toward the photocathode.

BEST MODE FOR CARRYING OUT THE INVENTION

Figure 1:
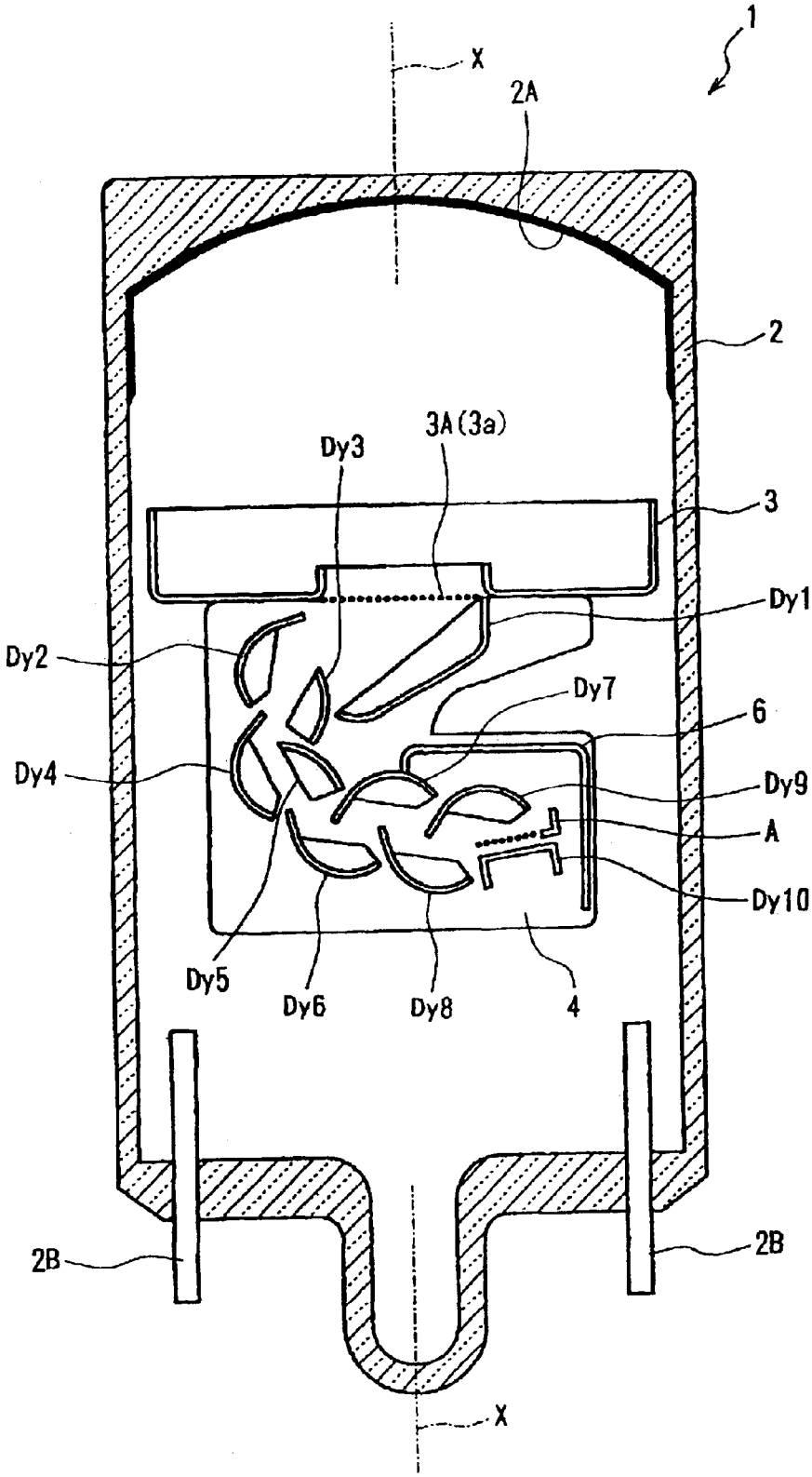
FIG. 1 is a cross-sectional view showing the photomultiplier tube 1 according to a preferred embodiment of the present invention.
Figure 2A:
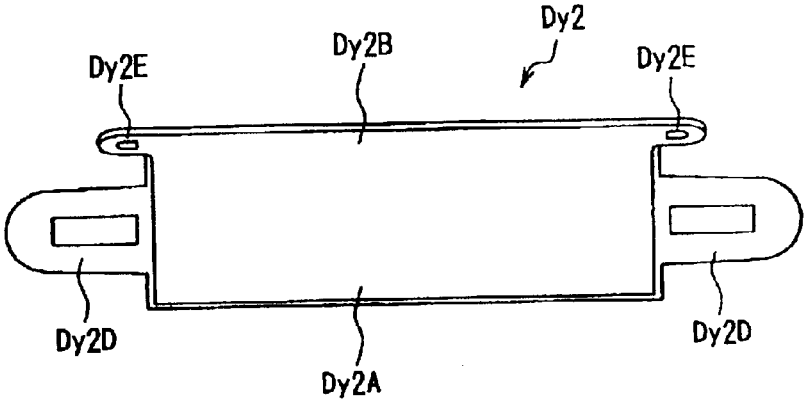
FIG. 2A is a front view.
Figure 2C:
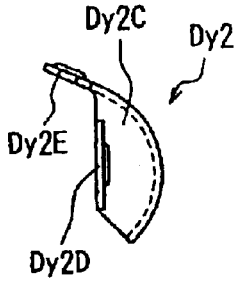
FIG. 2C is a side view.
Figure 2B:
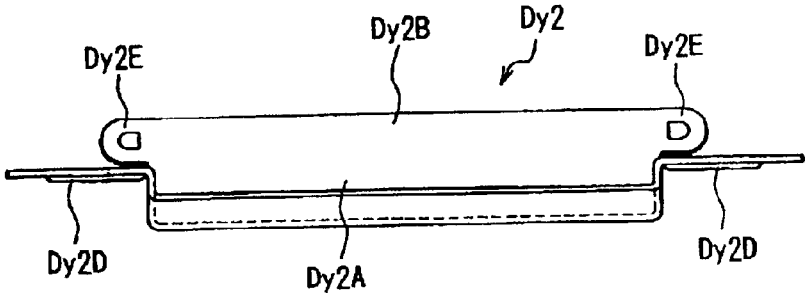
FIG. 2B is a bottom view.
Figure 2D:
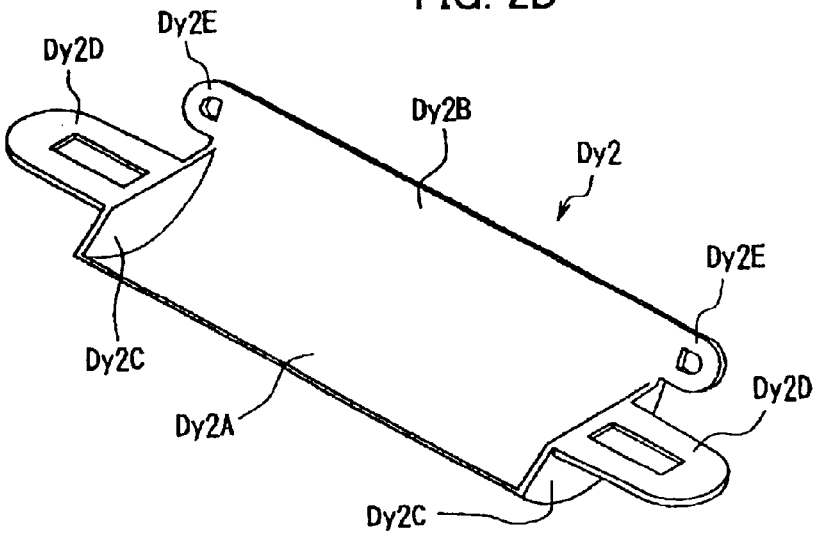
FIG. 2D is a perspective view showing the shape of the second, fourth, and sixth through ninth dynodes Dy2, Dy4, and Dy6–Dy9 in the photomultiplier tube 1 according to the preferred embodiment of the present invention.
Figure 3A:
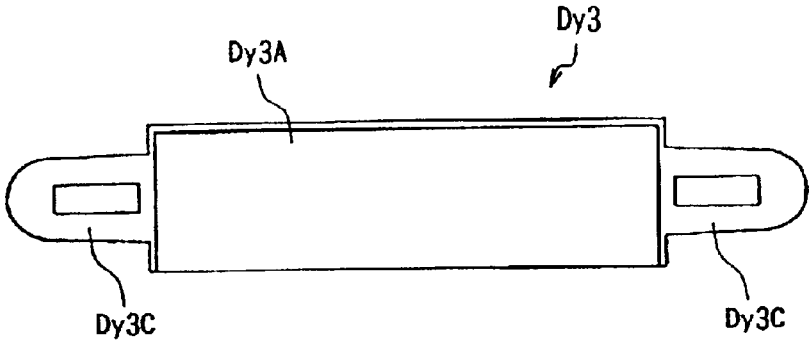
FIG. 3A is a front view.
Figure 3C:
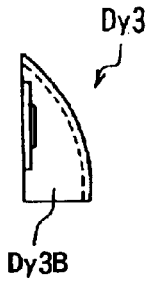
FIG. 3C is a side view.
Figure 3B:
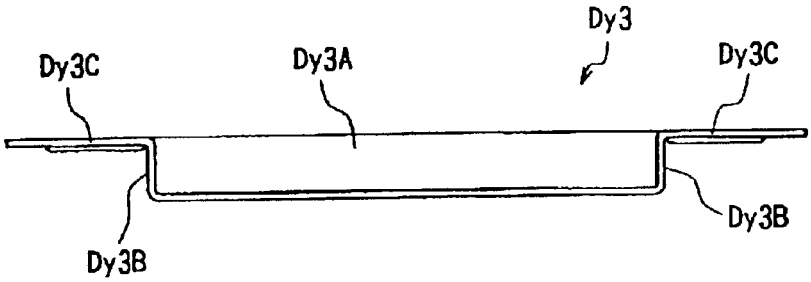
FIG. 3B is a bottom view.
Figure 3D:
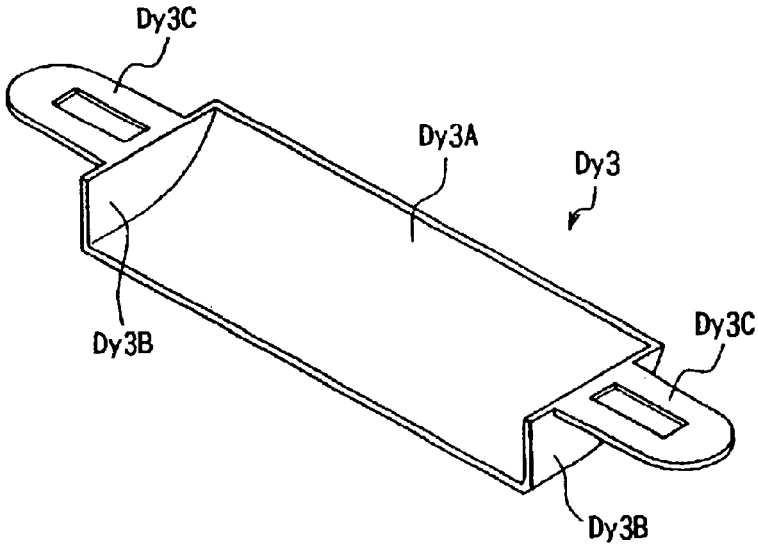
FIG. 3D is a perspective view of showing the shape of the third and fifth dynodes Dy3 and Dy5 in the photomultiplier tube 1 according to the preferred embodiment of the present invention.

A photomultiplier tube according to a preferred embodiment of the present invention will be described based on FIGS. 1–6. A photomultiplier tube 1 according to the preferred embodiment includes a tube-shaped vacuum vessel 2 having a tube axis X. FIG. 1 is a cross-sectional view of the photomultiplier tube 1 cut along the tube axis X. The tube-shaped vacuum vessel 2 is formed from a material such as Kovar glass.

Both ends of the tube-shaped vacuum vessel 2 along the tube axis X are closed. The one end has a planar shape. A photocathode 2A is formed on an inner surface of this planar end for emitting electrons in response to incident light. The photocathode 2A is formed by reacting an alkali metal vapor with antimony that has been pre-deposited on the inner surface of the end. A plurality of lead pins 2B are provided on the other end of the tube-shaped vacuum vessel 2 for applying predetermined potentials to dynodes Dy1–Dy10 and an anode A. FIG. 1 shows only two of the lead pins 2B for convenience of illustration. Connecting parts not shown in the drawings serve to connect the photocathode 2A to a corresponding lead pin 2B, via which a potential of −1000 V is applied to the photocathode 2A.

A cup-shaped focusing electrode 3 having a surface perpendicular to the tube axis X is disposed on a position of the vessel 2 facing the photocathode 2A. A center opening 3*a* centered at the point of intersection of the tube axis X and on a plane perpendicular thereto is formed in the focusing electrode 3. A mesh electrode 3A is mounted in the center opening 3*a*. The focusing electrode 3 and mesh electrode 3A are connected to corresponding lead pins 2B and have the same potential as the first dynode Dy1.

The dynodes Dy1–Dy10 for sequentially multiplying electrons are disposed on the opposite side of the focusing electrode 3 from the photocathode 2A. Each of the dynodes Dy1–Dy10 has a secondary electron surface.

The first dynode Dy1 is disposed at a position facing the center opening 3*a* and intersecting the tube axis X. The dynodes Dy1–Dy10 are disposed such that the secondary electron surfaces of neighboring dynodes oppose each other. The dynodes Dy1–Dy10 are positioned such that the paths formed in spaces between opposing dynodes continue from one to the next and intersect the tube axis X. The anode A is disposed on the opposite side of the tube axis X from the second dynode Dy2. That is, as shown in FIG. 1, the second dynode Dy2 is positioned on the left side of the tube axis X, while the anode A is positioned on the right side. The mesh-shaped anode A is positioned between the tenth dynode Dy10, serving as the final stage, and the ninth dynode Dy9, one stage above the final stage.

Each of the dynodes Dy1–Dy10 and the anode A are connected to corresponding lead pins 2B by wires not shown in the drawings via which predetermined voltages are applied to the dynodes Dy1–Dy10 and the anode A. In the present embodiment, the voltages applied to the dynodes Dy1–Dy10 are as follows: the first dynode Dy1=−800 V, the second dynode Dy2=−720 V, the third dynode Dy3=−640 V, the forth dynode Dy4=−560 V, the fifth dynode Dy5=−480 V, the sixth dynode Dy6=−400 V, the seventh dynode Dy7=−320 V, the eighth dynode Dy8=−240 V, the ninth dynode Dy9=−160 V, the tenth dynode Dy10=−80 V, and the anode A=0 V.

The second, forth, and sixth to ninth dynodes Dy2, Dy4, and Dy6–Dy9 are formed in identical shapes. FIG. 2 shows the shape of the second dynode Dy2 in more detail. The second dynode Dy2 has a curved surface Dy2A having an arcuate cross-section and a flat surface Dy2B formed continuously and flush with the curved surface Dy2A. The curved surface Dy2A and the flat surface Dy2B constitute the secondary electron surface. Side walls Dy2C erected from the curved surface Dy2A are formed through a pressing process on either lengthwise end of the curved surface Dy2A. First ears Dy2D extend outward from both side surfaces of the side walls Dy2C. Second ears Dy2E extend outward from both lengthwise ends of the flat surface Dy2B. The first and second ears Dy2D and Dy2E are not parallel to each other but form a fixed angle. Lugs are formed in the centers of the first ears Dy2D and second ears Dy2E by a pressing process.

The third and fifth dynodes Dy3 and DY5 have the same shape. FIG. 3 shows the shape of the third dynode Dy3 in more detail. The third dynode Dy3 has a curved surface Dy3A with an arcuate cross-section. The curved surface Dy3A forms the secondary electron surface, and has a smaller surface area than the secondary electron surfaces of other dynodes (Dy2A+Dy2B). With this construction, the third dynode Dy3 (and dynode DY5) is formed smaller than other dynodes. Further, side walls Dy3B, Dy3B protrude from each end of the curved surface Dy3A by a pressing process. First ears Dy3C are formed in a planar shape and extend outward from the side walls Dy3B perpendicular, to the same on the opposite side from the curved surface Dy3A. Lugs are formed in the center portions of the first ears Dy3C by a pressing process.

Figure 6:
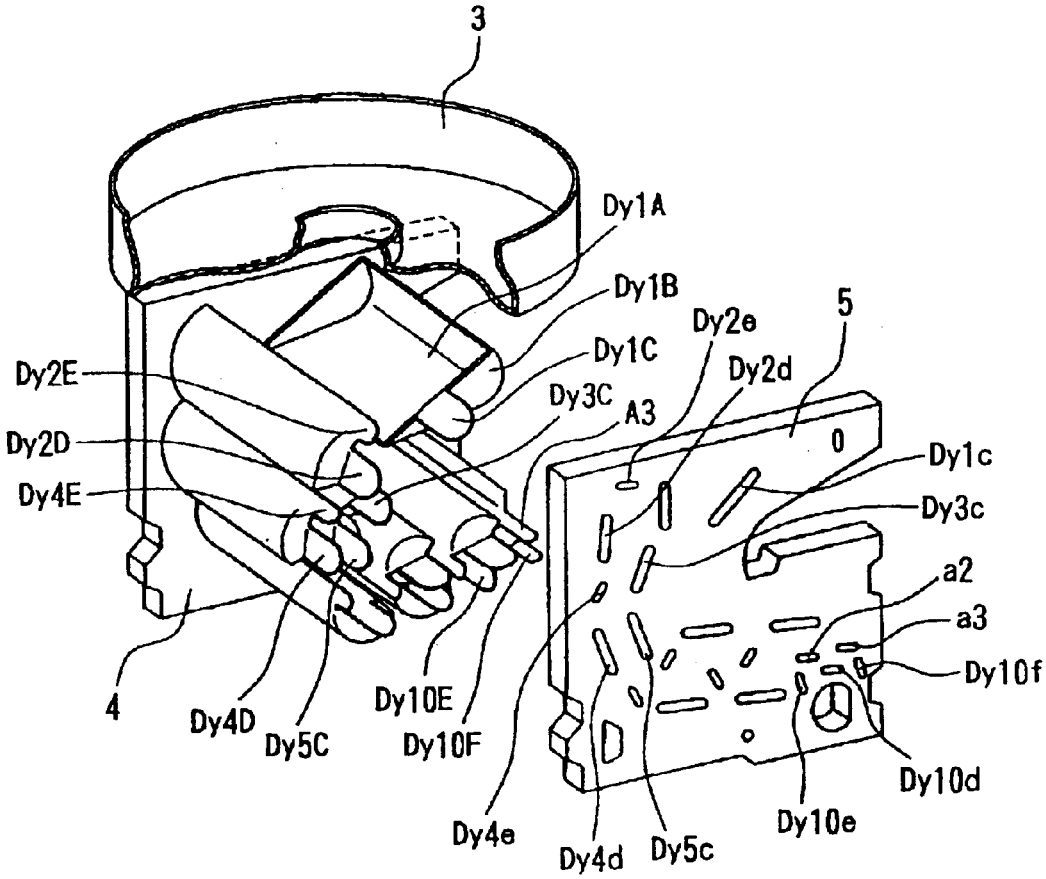
FIG. 6 is a perspective view showing how the dynodes Dy1–Dy10 and the anode A are inserted into the base plate 5.

As can be seen in FIG. 6, side surfaces Dy1B stand upward from secondary electron surfaces Dy1A on both lengthwise ends thereof, while first ears Dy1C extend outward from the side surfaces Dy1B. Lugs are formed in the center portions of the first ears Dy1C by a pressing process.

Figure 5:
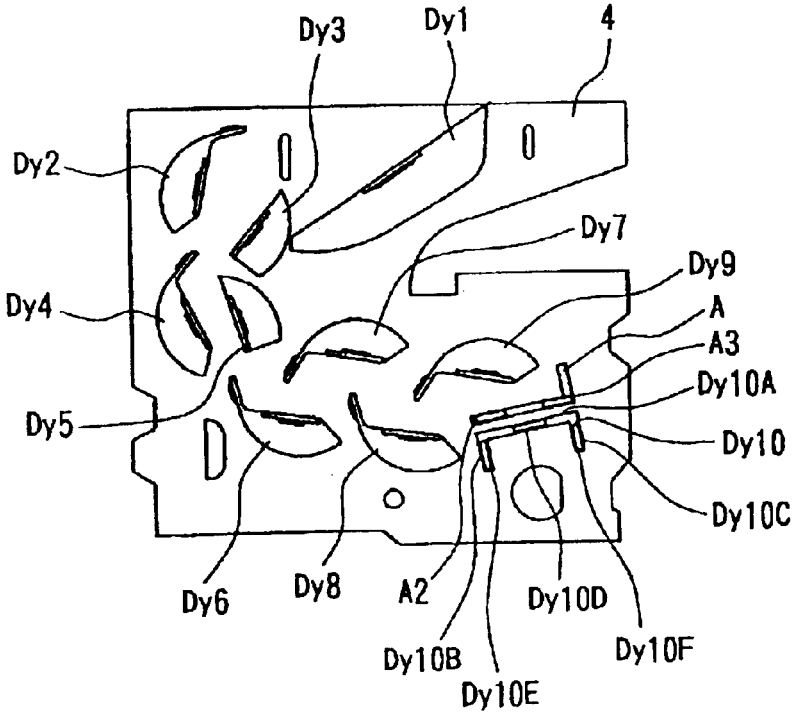
FIG. 5 is a front view showing the dynodes Dy1–Dy10 and the anode A retained in the base plate 4.

As shown in FIG. 5, the tenth dynode Dy10 has a planar secondary electron surface Dy10A and two surfaces Dy10B and Dy10C standing out from both ends of the secondary electron surface Dy10A. Hence, the tenth dynode Dy10 is formed in the shape of a three-sided rectangle. Three ears Dy10D, Dy10E, and Dy10F extend along the same plane as the secondary electron surfaces Dy10A, Dy10B, and Dy10C, respectively and are formed on both lengthwise ends of the same. The ears Dy10E and Dy10F are parallel to one another, while the ear Dy10D is perpendicular to the ears Dy10E, Dy10F. Lugs are formed in the center portions of the ears Dy10D, Dy10E, and Dy10F by a pressing process.

Figure 4:
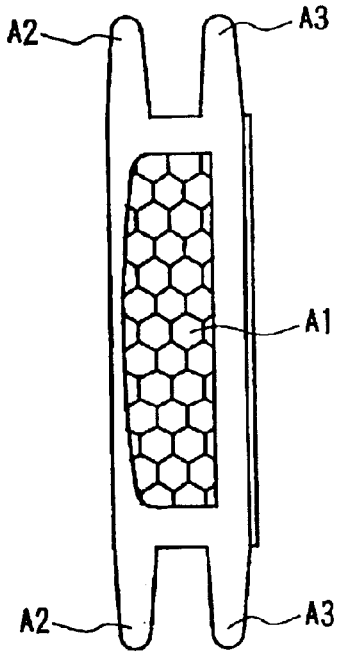
FIG. 4 is a front view showing an anode A in the photomultiplier tube 1 according to the preferred embodiment of the present invention.

As shown in FIG. 4, the anode A has a secondary electron receiving unit A1 including a flat-shaped mesh construction. Ears A2 and A3 formed on the same plane as the receiving unit A1 extend outward from both lengthwise ends of the same.

As shown in FIG. 6, the dynodes Dy1–Dy10 and the anode A are supported on both lengthwise ends in base plates 4 and 5. Slit-shaped fixing holes Dy1*c*, Dy2*d*, Dy2*e*, Dy3*c*, Dy4*d*, Dy4*e*, Dy5*c*, Dy10*d*, Dy10*e*, Dy10*f*, a2, and a3 are formed in the base plate 5. Although not shown in the drawings, identical slit-shaped fixing holes are formed in the base plate 4.

FIG. 5 is a front view showing the dynodes Dy1–Dy10 and the anode A supported in the base plate 4 but not yet supported in the base plate 5. FIG. 6 shows the dynodes Dy1–Dy10 and the anode A about to be inserted into the base plate 5. The following description is identical for the case of supporting the ears Dy1C, Dy2D, Dy2E, Dy3C, Dy4D, Dy4E, Dy5C, Dy10D, Dy10E, and Dy10F of the dynodes Dy1–Dy10 and the anode A in the base plate 4.

The first dynode Dy1 is supported in the base plate 5 by inserting the first ear Dy1C into the fixing hole Dy1*c*. The second dynode Dy2 is supported in the base plate 5 by inserting the first ear Dy2D into the fixing hole Dy2*d* and inserting the second ear Dy2E into the fixing hole Dy2*e*. The third dynode Dy3 is supported in the base plate 5 by inserting the first ear Dy3C into the fixing hole Dy3*c*. The forth dynode Dy4 is supported in the base plate 5 by inserting the first ear Dy4D into the fixing hole Dy4*d* and inserting the second ear Dy4E into the fixing hole Dy4*e*. The fifth dynode Dy5 is supported in the base plate 5 by inserting the first ear Dy5C into the fixing hole Dy5*c*. As with the second and fourth dynodes Dy2 and Dy4, the dynodes Dy6–Dy9 are supported in the base plate 5 by inserting the first ears and second ears into the corresponding fixing holes. The tenth dynode Dy10 is supported in the base plate 5 by inserting the ear Dy10D into the fixing hole Dy10*d*, inserting the ear Dy10E into the fixing holes Dy10, and inserting the ear Dy10F into the fixing hole Dy10*f*. The anode A is supported in the base plate 5 by inserting the ear A2 into the fixing hole a2 and the ear A3 into the fixing hole a3.

Because the lugs are formed in each ear, as described above, the ear portions can be inserted into their corresponding fixing holes at this time. Therefore, the dynodes Dy1–Dy10 are suitably fixed in the base plate 5. The sixth through ninth dynodes Dy1–Dy10 are secured to the base plate 5 in the same manner.

At this time, the first ears Dy1C, Dy2D, Dy3C, Dy4D, and Dy5C, and the ears Dy10E, Dy10F, A2, and A3 are formed longer than the thickness of the base plate 5, thereby protruding from the other side of the base plate 5. These ears serve as terminals for connecting to the lead pins 2B. The similar structure and way to connect the lead pins are applied to the first ears of the sixth through ninth dynodes Dy6–Dy9. By twisting the parts of the ears Dy1C, Dy2D, Dy3C, Dy4D, Dy5C, Dy10E, Dy10F, A2, and A3 protruding from the base plate 5, the dynodes Dy1 through Dy5 and Dy10 and the anode A can be more securely fixed to the base plate 5. The similar structure and way to be secured to the base plate 5 are applied to those of the sixth through ninth dynodes Dy6–Dy9.

Each of the second ears Dy2E and Dy4E and the ear Dy10D is formed shorter than the thickness of the base plate 5. These ears do not protrude from the outer side of the base plate 5 and therefore do not interfere with the wiring. The similar structure is applied to that of the second ears on the sixth through ninth dynodes Dy6–Dy9. Since the number of ears protruding from the base plate 5 can be decreased in this way, it is possible to avoid close arrangement of neighboring ears on dynodes Dy1–Dy10, thereby preventing the occurrence of electrical breakdown.

Normally, secondary electrons emitted from the secondary electron surface of an $i^{th}$ dynode Dyi impinge on a portion of high efficiency of the secondary electron surface in the $(i+1)^{th}$ dynode Dy(i+1). Accordingly, the $(i+2)^{th}$ dynode Dy(i+2) is configured to be inserted between the secondary electron surface of the $i^{th}$ dynode Dyi and the secondary electron surface of the $(i+1)^{th}$ dynodes Dy(i+1). In the photomultiplier tube 1 of the present embodiment, the dynodes Dy1–Dy10 are arranged in a curving series in order that the path formed in the spaces between dynodes crosses the tube axis. Accordingly, a greater distance is formed between dynodes arranged on the outer part of the path. Consequentially, the $(i+2)^{th}$ dynode Dy(i+2) positioned on the outer side of the curve generally does not penetrate between the secondary electron surfaces of the $i^{th}$ dynodes Dyi and the secondary electron surfaces of the $(i+1)^{th}$ Dy(i+l). However, the secondary electron surfaces of the second, fourth, sixth, and eighth dynodes Dy2, Dy4, Dy6, and Dy8 disposed on the outer part of the curve in the present embodiment are formed continuously with the curved surfaces Dy2A, Dy4A, Dy6A, and Dy8A having an arcuate cross-section and the flat surfaces Dy2B, Dy4B, Dy6B, and Dy8B flush with the curved surfaces Dy2A, Dy4A, Dy6A, and Dy8A. Therefore, as shown in FIG. 1, the $(i+2)^{th}$ dynode Dy(i+2) penetrates between the secondary electron surfaces of the $i^{th}$ dynodes Dyi and the secondary electron surfaces of the $(i+1)^{th}$ Dy(i+1). As a result, the potential of the $(i+2)^{th}$ dynode Dy(i+2) leaks between the $i^{th}$ dynodes Dyi and the $(i+1)^{th}$ Dy(i+1). Hence, secondary electrons emitted from the secondary electron surface of the $i^{th}$ dynode Dyi are attracted to the $(i+2)^{th}$ dynode Dy(i+2), thereby impinging on the part of high efficiency in the secondary electron surface of the $(i+1)^{th}$ Dy(i+1).

Here, the secondary electron surfaces of the third and fifth dynodes Dy3 and DY5 are formed only by the parts having an arcuate cross-section in order to facilitate reception of electrons from the previous dynodes Dy2 and Dy4. Moreover, the secondary electron surfaces are adjusted to emit electrons in a direction slightly toward the previous dynodes Dy2 and Dy4 so that the secondary electrons trace a correct trajectory in relation to the next dynodes Dy4 and Dy6. If the secondary electron surfaces of the third and fifth dynodes Dy3 and Dy5 were flat, too much potential of the dynodes Dy3 and Dy5 would leak between the dynodes Dy2 and Dy4 and the dynodes Dy1 and Dy3, causing electrons from the dynodes Dy1 and Dy3 to be attracted to the back surfaces of the dynodes Dy3 and Dy5. This would make it difficult to impinge secondary electrons on the secondary electron surfaces of the second and forth dynodes Dy2 and Dy4. Electrons emitted from the secondary electron surfaces of the second and forth dynodes Dy2 and Dy4 would be attracted to the potential of the fifth and seventh dynodes Dy5 and Dy7. Accordingly, the electrons would either not impinge at a desirable position on the dynodes third and fifth Dy3 and Dy5 or would slip past the next dynodes and impinge on the back surfaces of the fifth and seventh dynodes Dy5 and Dy7.

Further, the secondary electron surfaces of the third and fifth dynodes Dy3 and Dy5 have a smaller surface area than those of the secondary electron surfaces of the second, fourth, and sixth through ninth dynodes Dy2, Dy4, and Dy6 through Dy9 in order to reduce the size of the third and fifth dynodes Dy3 and Dy5 arranged in the center of the curved series of dynodes. Hence, the dynodes Dy1–Dy10 can be arranged in a curved series such that the path in the spaces between dynodes crosses the tube axis. On the other hand, the secondary electron surfaces of the seventh and ninth dynodes Dy7 and Dy9 arranged on the inner side of the curved series have the same surface area as the secondary electron surfaces of the second, fourth, sixth, and eighth dynodes Dy2, Dy4, Dy6, and Dy8 arranged on the outer side of the curved series in order to slightly relax the increasing density of electrons near the secondary electron surfaces of the dynodes Dy7 and Dy9 positioned relatively close to the final stage.

As shown in FIG. 1, a flat shielding plate 6 is provided parallel to the photocathode 2A and positioned around the dynodes Dy1–Dy10. The shielding plate 6 is positioned between the dynodes Dy7–Dy10 near to the last dynode and the first dynode Dy1 to prevent light or ions generated when electrons collide with the dynodes Dy7–Dy10 near to the last dynode from migrating toward the photocathode 2A. A predetermined voltage is applied to the shielding plate 6 by connecting the shielding plate 6 to a corresponding lead pin 2B.

Next, the operations of the photomultiplier tube 1 according to the preferred embodiment will be described with reference to FIG. 1. When light is incident on the photocathode 2A, photoelectrons are emitted. The photoelectrons are converged by the focusing electrode 3 and transferred to the first dynode Dy1. At this time, secondary electrons are emitted from the first dynode Dy1 and sequentially transmitted to the second through tenth dynodes Dy2 through Dy10, causing an amplification cascade of sequentially generated secondary electrons. Ultimately, the secondary electrons are collected in the anode A and extracted therefrom as an output signal.

The photomultiplier tube according to the present invention is not limited to the embodiment described above, but may be subjected to many modifications and variations without departing from the scope or the spirit of the invention, the scope of which is defined by the attached claims. For example, the secondary electron surfaces of the third and fifth dynodes in the embodiment described above are formed with an arcuate cross-section. However, these surfaces can be given a composite shape having a curved surface with an arcuate cross-section and a flat shape flush with the curved surface as in the second, fourth, and sixth through ninth dynodes and can be decreased in size while maintaining a congruous shape with the second, fourth, and sixth through ninth dynodes.

Industrial Applicability

The present invention described above can be applied to a wide range of applications requiring high precision optical detection and requiring good vibration resistance such as oil exploration and good pulse linearity characteristics.

What is claimed is:

1. A photomultiplier tube comprising:

a tube-shaped vacuum vessel (2) extending along the tube axis (X);

a photocathode (2A) positioned on one end of the tube axis of the tube-shaped vacuum vessel (2) for photoconverting incident light to emit electrons;

first to $n^{th}$ dynodes (Dy1–Dy10), each having a secondary electron surface formed on an inner wall for multiplying electrons sequentially; and an anode (A) for receiving the electrons multiplied by the first to $n^{th}$ dynodes (Dy1–Dy10), characterized in that a first dynode (Dy1) is positioned opposite to the photocathode (2A), when i is an integer greater than or equal to 2 and less than or equal to (n−1), a secondary electron surface of an $i^{th}$ dynode is positioned opposite to a secondary electron surface of an $(i-1)^{th}$ dynode and a secondary electron surface of an $(i+1)^{th}$ dynode, Dynodes having the same shape as a shape of a second dynode (Dy2) are used as an $(n-2)^{th}$ dynode and an $(n-1)^{th}$ dynode (Dy8, Dy9), while smaller dynodes than the second dynode (Dy2) are used as a third dynode and a fifth dynode (Dy3, Dy5), the first to $n^{th}$ dynodes are arranged so that a path formed in a spaces between opposing dynodes crosses the tube axis, a mesh type of anode is used as the anode (A), the mesh type of anode is placed on an opposite side of the second dynode (Dy2) with respect to the tube axis (X).

2. The photomultiplier tube according to claim 1, characterized in that a secondary electron surface of the second dynode (Dy2) has a curved face (Dy2A) having an arcuate section and a plane (Dy2B) continuous and flush with the curved face (Dy2A).

3. The photomultiplier tube according to claim 1 or 2, characterized in that an $(n-3)^{th}$ dynode (Dy7) has a substantially identical shape with the second dynode.

4. The photomultiplier tube according to claim 3, characterized in that an $(n-4)^{th}$ dynode (Dy6) has a substantially identical shape with the second dynode.

5. The photomultiplier tube according to claim 3, characterized in that the secondary electron surfaces of the third and fifth dynodes (Dy3, Dy5) consists of a curved surface (Dy3A) having an arcuate cross-section.

6. The photomultiplier tube according to claim 3, characterized in that the third and fifth dynodes have substantially similar shapes to the shape of the second dynode (Dy2).

7. The photomultiplier tube according to claim 1 or 2, characterized in that an $(n-4)^{th}$ dynode (Dy6) has a substantially identical shape with the second dynode.

8. The photomultiplier tube according to claim 7, characterized in that the secondary electron surfaces of the third and fifth dynodes (Dy3, Dy5) consists of a curved surface (Dy3A) having an arcuate cross-section.

9. The photomultiplier tube according to claim 7, characterized in that the third and fifth dynodes have substantially similar shapes to the shape of the second dynode (Dy2).

10. The photomultiplier tube according to claim 1, 2, or 4, characterized in that the secondary electron surfaces of the third and fifth dynodes (Dy3, Dy5) consists of a curved surface (Dy3A) having an arcuate cross-section.

11. The photomultiplier tube according to claim 1, 2, or 4, characterized in that the third and fifth dynodes have substantially similar shapes to the shape of the second dynode (Dy2).

12. The photomultiplier tube according to claim 1, characterized in that a shielding plate (6) is provided between the first dynode (Dy1) and the $(n-3)^{th}$ through $n^{th}$ dynode (Dy7–Dy10).

* * * * *

UNITED STATES PATENT AND TRADEMARK OFFICE

CERTIFICATE OF CORRECTION

PATENT NO. : 6,946,792 B2
DATED : September 20, 2005
INVENTOR(S) : Suenori Kimura et al.

It is certified that error appears in the above-identified patent and that said Letters Patent is hereby corrected as shown below:

Title page,
Item [54], Title, should be -- PHOTOMULTIPLIER TUBE --.
Item [75], Inventors, "Suenori Kimura, Hamammatsu (JP)" should be -- Suenori Kimura, Hamamatsu (JP) --.

Signed and Sealed this

Twenty-first Day of February, 2006

JON W. DUDAS
*Director of the United States Patent and Trademark Office*